United States Patent [19]

Alkner et al.

[11] 4,399,765

[45] Aug. 23, 1983

[54] FLOATING CONTAINER FOR RECEIVING AND TRANSPORTING COLLECTED OIL POLLUTANTS

[75] Inventors: Stig H. I. Alkner, Ystad; Sture H. Soderstrom, Trelleborg, both of Sweden

[73] Assignee: Trelleborg AB, Trelleborg, Sweden

[21] Appl. No.: 300,417

[22] Filed: Sep. 9, 1981

[30] Foreign Application Priority Data

Sep. 19, 1980 [SE] Sweden ..... 8006572

[51] Int. Cl.[3] ..... B65D 88/12

[52] U.S. Cl. ..... 114/256; 114/74 T; 405/210

[58] Field of Search ..... 405/210; 150/0.5, 1; 114/256, 257, 74 T, 345

[56] References Cited

U.S. PATENT DOCUMENTS 3,067,712 12/1962 Doerpinghaus ..... 114/74 T 3,779,196 12/1973 Knaus ..... 114/74 T 4,227,477 10/1980 Preus ..... 114/256

*Primary Examiner*—Trygve M. Blix

*Assistant Examiner*—C. T. Bartz

*Attorney, Agent, or Firm*—Beveridge, DeGrandi and Kline

[57] ABSTRACT

A floating container for receiving and transporting collected oil pollutants has an elongate, hose-shaped body with towing attachments and buoyancy bodies disposed on the outside thereof and serving as rubbing strakes or fenders, and a large filling and discharge opening surrounded by an inflatable buoyancy collar. The discharge opening is sealable by means of a cover and is sufficiently large to allow the introduction of an immersible pump intended for discharging of the contents of the container. The discharge opening is either triangular and has its one apex directed towards the towing attachments, or is oval and has its major axis directed in the longitudinal direction of the hose-shaped body.

8 Claims, 3 Drawing Figures

13
12
16
11
10
14

13
12
16
19
17
III
15
III
11
11
10
14

11
10
16
18
17
15

FLOATING CONTAINER FOR RECEIVING AND TRANSPORTING COLLECTED OIL POLLUTANTS

The present invention relates to a floating container for receiving and transporting collected oil pollutants, the container being in the form of an elongate hose-shaped body manufactured of flexible, liquid-tight material and being provided with fixedly retained, inflatable buoyancy bodies and towing attachments.

Containers of this type are used as receptacles for oil pollutants in oil dispersal operations at sea. In prior art hose-shaped receptacles, filling is effected by the intermediary of relatively large-sized hoses which are directly connected to the interior of the hose-shaped receptacle, the prior art receptacles often having some type of extra buoyancy body which keeps the receptacle afloat before it has been filled with oil. In such a prior art construction, these buoyancy bodies are inflatable and are disposed on the inner side of the hose-shaped body. In such cases, there is often also an inflatable compartment at that end of the hose-shaped body where the towing attachments are disposed. This extra, inflatable compartment serves to hold up the forward end of the hose-shaped body during towing.

It has proved that the prior art hose-shaped containers are difficult to employ in cold weather, since the oil pollutants involved are then often extremely viscous or semisolid. In such conditions, considerable problems arise especially on emptying of the hose-shaped receptacles. As a result, proposals have been recently put forward in the art for a floating container which is also intended for transport of oil pollutants, this container being designed as a large floating basin whose upper edge is surrounded by a buoyancy collar which keeps the basin or container afloat. The basin is closed, but has, at its bottom, drainage openings for allowing the discharge of water which sediments out from the oil waste collected in the basin. Such a basin-like floating container is excellent inasmuch as it is easy to empty by means of immersible pumps which are lowered into the basin through the large opening within the buoyancy collar. However, experience has shown that this type of container is very difficult to tow because of its great resistance to flow.

Consequently, the object of the present invention is to obviate the disadvantages inherent in both of the abovementioned, prior art container types and to realize a floating container of the type disclosed by way of introduction, this floating container being characterized in that the hose-shaped body has a large filling and discharge opening surrounded by an inflatable buoyancy collar and sealable by means of a cover. This discharge opening is preferably triangular and has, in such an event, its one apex directed towards the most proximal end of the hose-shaped body such that the buoyancy collar offers the least possible flow resistance on towing of the hose-shaped body. Alternatively, the refilling and discharge opening can be oval in configuration and, in such an event, is directed with its major axis in the longitudinal direction of the hose-shaped body.

The buoyance bodies that may be utilized for keeping afloat the hose-shaped body, before the container has been filed with oil pollutants are, according to a preferred embodiment of the present invention, to be disposed on the outside of the hose-shaped body and extend along the longitudinal sides thereof to serve, at the same time, as rubbing strakes or fenders.

One great advantage inherent in the container according to the present invention is that it is easy to discharge, an advantage which is particularly manifest if the filling or discharge opening is disposed in the vicinity of that end of the hose-shaped body where the towing attachments are mounted. In such an event, it is most appropriate to dispose, at the opposite end of the hose-shaped body, lifting or attachment means to allow for the lifting of that end on discharging of the hose-shaped body.

One example of a floating container according to the present invention will be described in greater detail below with reference to the accompanying drawing, in which.

Figures 1, 2, 3:
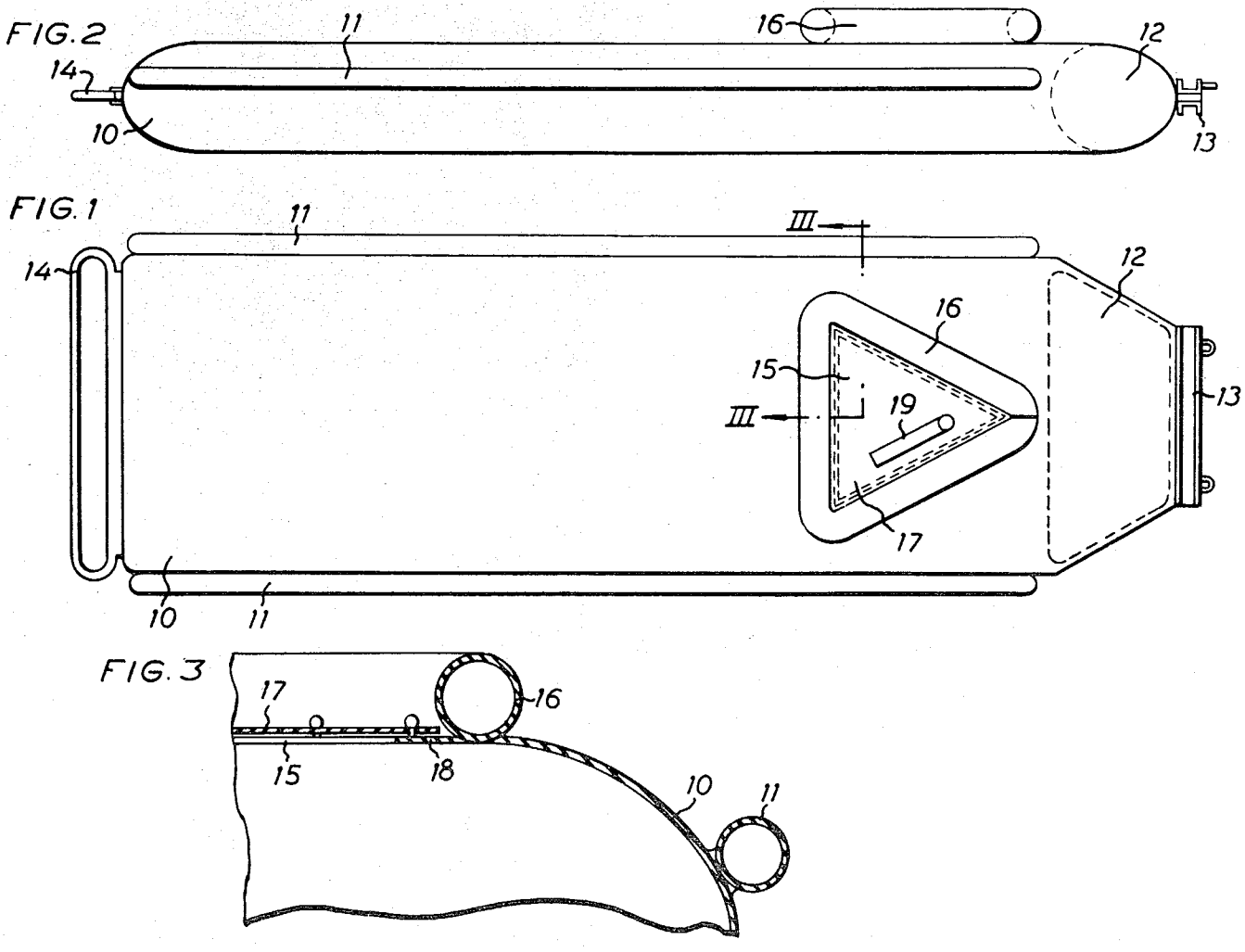
FIG. 1 is a top plan view of the containter.
FIG. 2 is a side elevation of the container.
FIG. 3 is a section taken along the line III—III in FIG. 1.

The floating container according to the invention is in the form of an elongate, hose-shaped body 10 which is made of a flexible, liquid-tight material, for example rubber-coated fabric. The hose-shaped body may be of considerable length, for example up to 15 m and, in the flattened-out state, have a width of, for example, 3.5 m. The hose-shaped body is sealed at its forward and rear ends and has, along its longitudinal sides, elongate, inflatable buoyancy bodies 11 which are fixedly secured to the outside of the elongate hose-shaped body. The function of these buoyancy bodies is twofold; first, as buoyancy bodies to keep afloat the hose-shaped body before it has been filled with oil pollutants and, second, to serve as rubbing strakes or fenders so that the hose-shaped body may be made fast alongside a vessel without the risk of damage to the container wall proper. The hose-shaped body has, at its forward end, a buoyancy body 12 which, in the illustrated embodiment, fills out the forwardly-directed bow end of the hose-shaped body and which serves as a buoyancy body to hold up the forward end above the water level during towing of the container. In order to make such towing possible, towing attachments in the form of two crossbeams 13 clamped about the forward end of the container are provided. At the opposite end of the container, a lifting loop 14 has been fixedly mounted in order to serve partly as an attachment on lifting of this container end and partly for making fast the container alongside a vessel.

The container according to the invention has, on its upper side and in the vicinity of its forward end, a large opening 15 which is surrounded by a buoyancy collar 16. In this embodiment of the invention, the opening is triangular in configuration and has its one apex directed towards the towing attachments 13 in order that the buoyancy collar exercise as little resistance as possible to the water during towing. This large opening is provided with a cover 17 which is fixedly disposed on an inwardly directed flange 18 by means of a so-called TIR closure, that is to say the cover is provided with holes having eyelets, and the inwardly directed flange 18 has fixedly disposed lugs which are projected through these eyelets, whereafter a line is passed through the row of eyelets. The cover 17 has, in the preferred embodiment, been provided with a filling socket 19 in the form a hose which may be sealed at its one end and whose other end opens on the inside of the cover. This hose may be coupled to a pump or other filling apparatus. On discharging of the container, the cover 17 is opened so that an immersible pump may be lowered into the interior of the container for efficient discharging thereof. During the discharging, the oil pollutants may progressively be moved forward towards the opening end in that the container is raised in the lifting loop 14.

We claim:

1. A floating container for receiving and transporting collected oil pollutants, said container being in the form of an elongate, hose-shaped body (10) of flexible, liquid-tight material and being provided with fixedly secured, inflatable buoyancy bodies (11) and towing attachments (13), wherein said hose-shaped body (10) has a large filling and discharge opening (15) surrounded by an inflatable buoyancy collar (16) and sealable by means of a cover (17), said hose-shaped body having an internal chamber for holding said collected oil pollutants, said body having an upper wall of said flexible liquid-tight material which comprises an upper wall of said internal chamber, said filling and discharge opening being formed in said upper wall to provide direct access into said internal chamber, said inflatable buoyancy collar surrounding said opening in proximity thereto to keep the opening above sea level and to keep the opening in its open state after removal of the cover.

2. The container as claimed in claim 1, wherein the filling and discharge opening (15) is triangular and has one apex directed towards the most longitudinally proximal end (13) of the hose-shaped body (10).

3. The container as claimed in claim 1, wherein the filling and discharge opening (15) is oval and has its major axis directed in the longitudinal direction of the hose-shaped body (10).

4. The container as claimed in any of the preceding claims, wherein the buoyancy bodies (11) of the container are disposed on the outside of the hose-shaped body (10) and extend along the longitudinal sides thereof as rubbing strakes or fenders.

5. The container as claimed in any one of claims 1, 2 or 3, in which towing attachments (13) are disposed at one longitudinal end of the hose-shaped body (10), wherein the filling and discharge opening (15) is disposed in the vicinity of that end of the hose-shaped body where the towing attachments are disposed, and wherein the hose-shaped body has, at its opposite end, lifting or attachment means (14) for making possible lifting of said end on emptying of the hose-shaped body.

6. The container as claimed in claim 5, wherein the buoyancy bodies (11) of the container are disposed on the outside of the hose-shaped body (10) and extend along the longitudinal sides thereof as rubbing strakes or fenders.

7. The container as claimed in claim 1 wherein the inflatable buoyancy collar and the filling and discharge opening therewithin are triangular and have one apex directed toward the most longitudinally proximal end of the hose-shaped body.

8. The container as claimed in claim 1 wherein the inflatable buoyancy collar and the filling and discharge opening therewithin are oval and have their major axes directed in the longitudinal direction of the hose-shaped body.

* * * * *